US005368501A

United States Patent [19]

Asbell

[11] Patent Number: 5,368,501

[45] Date of Patent: Nov. 29, 1994

[54] ROTARY ACTUATED, ENVIROMENTAL, INSULATION DISPLACEMENT CONNECTOR

[75] Inventor: Oscar D. Asbell, Atlanta, Ga.

[73] Assignee: Georgia Tech Research Corporation, Atlanta, Ga.

[21] Appl. No.: 162,848

[22] Filed: Dec. 6, 1993

[51] Int. Cl.[5] ..... H01R 4/24

[52] U.S. Cl. ..... 439/418; 439/409; 439/259

[58] Field of Search ..... 439/395–407, 439/417–419, 341, 372, 259, 261, 262

[56] References Cited

U.S. PATENT DOCUMENTS

| | | | |
|---|---|---|---|
| 2,584,476 | 2/1952 | Liaci | 439/418 |
| 4,247,159 | 1/1981 | Fruchard | 339/95 |
| 4,413,872 | 11/1983 | Rudy, Jr. et al. | 439/410 |
| 4,652,070 | 3/1987 | Suffi | 339/97 |
| 4,726,785 | 2/1988 | Kerboul | 439/417 |
| 4,891,018 | 1/1990 | Afflerbaugh et al. | 439/402 |
| 4,917,633 | 4/1990 | Lacoste | 439/722 |
| 5,096,437 | 3/1992 | Levy | 439/411 |
| 5,149,278 | 9/1992 | Waas et al. | 439/412 |
| 5,170,017 | 12/1992 | Stanevich et al. | 174/153 |

*Primary Examiner*—David L. Pirlot
*Attorney, Agent, or Firm*—Hopkins & Thomas

[57] ABSTRACT

A rotary actuated connection device has, within a case, a crankshaft having an axis of rotation and first and second eccentric throws. Insulation displacement blades are movably mounted on the throws and move in translation into and out of a wire engaging or connection region upon rotation of the crankshaft. Wires to be connected are passed through an insulating gel within the case and into and through the engaging region to be engaged by the blades upon rotation of the crankshaft, with a stop arrangement for limiting the rotation of the crankshaft. A protective device is mounted within the case and is electrically connected to the wires when the blades are in the engaging position. The region in the case where the protective device is mounted is filled with a potting compound.

22 Claims, 3 Drawing Sheets

ROTARY ACTUATED, ENVIROMENTAL, INSULATION DISPLACEMENT CONNECTOR

FIELD OF INVENTION

This invention relates to communication station protector type connectors and, more particularly, to an insulation displacement connector for connecting sets of wires at a customer station, for example.

BACKGROUND OF THE INVENTION

Communication station protector connectors must be so designed and implemented as to eliminate risks of fire, shock, or injury to persons, and, especially, must be able to protect the connections from large voltage and current surges such as are caused by lightning. Inasmuch as most such connectors are located out of doors, the electrical connectors as nearly as possible must be immune to moisture from rain, heavy fog, flooding, or the like.

In terminal blocks, wherein several telephone subscriber circuits are connected, or in individual customer connectors, connections are generally made by means of binding posts. In the field, the technician must first strip the wires to be connected, then wrap them around the binding post, after which they are secured, generally by means of one or more nuts. Obviously, when used out of doors, such an arrangement is suscessible to the deleterious physical and electrical effects of moisture, even when the connector is contained in a housing. Additionally, from an economic standpoint, stripping and binding the wires is time consuming and requires a measure of skill on the part of the installer, all of which adds to the cost of the installations.

There are, in the prior art, numerous arrangements for making multiple connections among wires while affording at least some measure of protection from the elements. In U.S. Pat. No. 4,891,018 of Afflerbaugh et al., there is shown a solderless insulation displacement connector (IDC) in which the assembled connector and connected wires is encapsulated with soft plastic material such as, for example, a silicone grease, which protects the connections from atmospheric effects. The wires to be connected are inserted into the side of the connector and a vertically movable connecting member having slots therein for cutting through (or displacing) the insulation on the wires being connected is driven down into contact with the wires by a cap member which is pushed down by the installer and remains gripped in the down position. The encapsulation grease is then introduced.

In U.S. Pat. No. 5,096,437 of Levy, there is shown an electrical conductor block for connecting, by means of insulation displacement, a multiconductor cable to a plurality of drop wires. The block comprises a plurality of modules, each of which comprises one or more fixed insulation displacing contact elements which engage the drop wires inserted into the module from the side thereof. The wires are forced down into engagement with the contact elements by means of a bolt which, when turned drives a cap containing the wires down, forcing the wires into slots in the contact element. The region of the contacts is filled with a sealing agent for environmental protection. In the Levy arrangement, the wires of the cable are wrapped around terminals which are integral with the contact element. An arrangement quite similar to that of Levy is shown in U.S. Pat. No. 5,149,278 of Waas et al. which, however, uses an insulation displacement member for connecting to the cable.

In U.S. Pat. No. 4,917,633 of Lacoste there is shown a connector arrangement similar to the connector module of Levy, although somewhat more simple, wherein the wires to be connected are inserted from the side and the IDC slotted plate is forced against the wires by a slotted, threaded knob which is screwed onto a projecting lug. An insulating gel fills the free space within the connector.

In all of the foregoing arrangements, the wires to be connected are inserted into the connector from the side thereof, which presupposes that there is ample lateral space to make the insertion. This is not always the case, however. Connector arrangements of the type shown in the Levy and Waas et al. patents are also quite bulky. It is also possible in most of these arrangements to drive the slotted IDC member too far into the wire, thereby giving rise to the possibility of damaging or even severing the wire. Thus, the technician or installer must exercise a degree of skill in making the connection.

In most of the foregoing devices, some sort of insulating gel is inserted after the assembly has been made. This too requires some skill on the part of the installer as well as requiring him to carry a supply of such insulating material in his tool kit.

While none of the aforementioned patents show the use of a surge protector, such protectors are common and, where required, are added as a separate adjunct. Thus, a gas discharge tube, for example, must be connected by some means to the wires being connected to shunt the connection to ground in the event of a high voltage or current surge.

SUMMARY OF THE INVENTION

The present invention is an IDC connector which, as will be discussed with regard to an illustrative embodiment thereof, is so structured as to require a minimum of skill and effort on the part of the installer or technician, that is compact and requires little occupying space as well as little lateral space, and that contains, prier to the insertion of the wires to be connected, an insulating compound so located as to insure virtually complete immunity of the connections from moisture effects. The connector includes a surge protector as an integral part thereof and which is also immune from atmospheric effects.

The invention comprises, in an illustrative embodiment thereof, a case, open at the bottom and having a central bore in the top thereof. On either side of the bore are recesses or bores into which inverted caps are snapped. The closed end of the cap, i.e., the upper end, has a plurality of holes therein for insertion of the drop wire and the customer wires, which are to be connected together. At the bottom of each recess is a thin, rubber seal, and the interior volume of the cap is filled with a self-healing insulating gel. As used hereinafter, "gel" is intended to include insulating grease as well. First and second spacer members are located within the case and are bored to allow the drop wire and the customer wires as well as other wires to pass therethrough.

Located in the central bore is a shaft, the lower end of which terminates in an eccentric crankshaft having first and second offset throws which are located in a bore in the first spacer and a recessed portion of the second spacer, with the end of the crankshaft being journaled in the second spacer. A first insulation displacement blade is journaled on the first crankshaft throw and is supported horizontally between the first spacer and a portion of the case with freedom to move horizontally with respect thereto. A second insulation displacement blade is journaled on the second crankshaft throw and supported horizontally with freedom to move between the two spacers. Each of the blades is slotted to receive and cut the insulation of the drop wire and the customer wires, so that when the crankshaft is rotated, the blades are forced laterally outward into an engaging or connecting region or engagement with the wires, thereby connecting the drop wire and the customer wires. The construction of the crankshaft and the blades is such that the blades are automatically prevented from being driven too far into the wires, as will be explained more fully hereinafter, thereby preventing damage thereto. The lateral displacement of the blades makes possible a more compact structure than the vertical displacement common to the prior art.

Within the open space at the lower portion of the case is located a surge protecting device such as, in this embodiment, a gas discharge tube. The discharge tube has first and second electrodes at the ends thereof to which are connected wires which extend upward and are adapted to be engaged by the blades. A central electrode is connected to a ground lug, and the tube and wires are in cased within a suitable potting compound. In addition, first and second test wires may also be connected to the first and second end electrodes of the tube.

At installation, the drop wires and the customer wires are inserted from the top of the case down through the cap, through the insulating gel and the rubber seal and into and through the engagement or connecting regions for the blades where, upon rotation of the shaft and crankshaft, they are engaged by the blades which connects them electrically. The holes in the cap and the spacers guide the wires so that they are engaged by and fit in the proper slots in the blades.

From the foregoing, it can be seen that the region wherein the wires are connected together is totally protected from atmospheric effects without the necessity of introducing an insulating gel into that region. In addition, inasmuch as the wires to be connected are all inserted from the top of the case, the connector may be located or confined in a small space with only access to the top thereof being required. The installer or technician is not required to strip any wires nor to inject any insulating compound. In addition, wires may be pulled out of the connector through the insulating gel without compromising the atmospheric integrity of the connections and the connector.

These and other features and advantages of the present invention will be more readily apparent from the following detailed description, read in conjunction with the accompanying drawings.

DESCRIPTION OF TEE DRAWINGS

DETAILED DESCRIPTION

Figure 1:
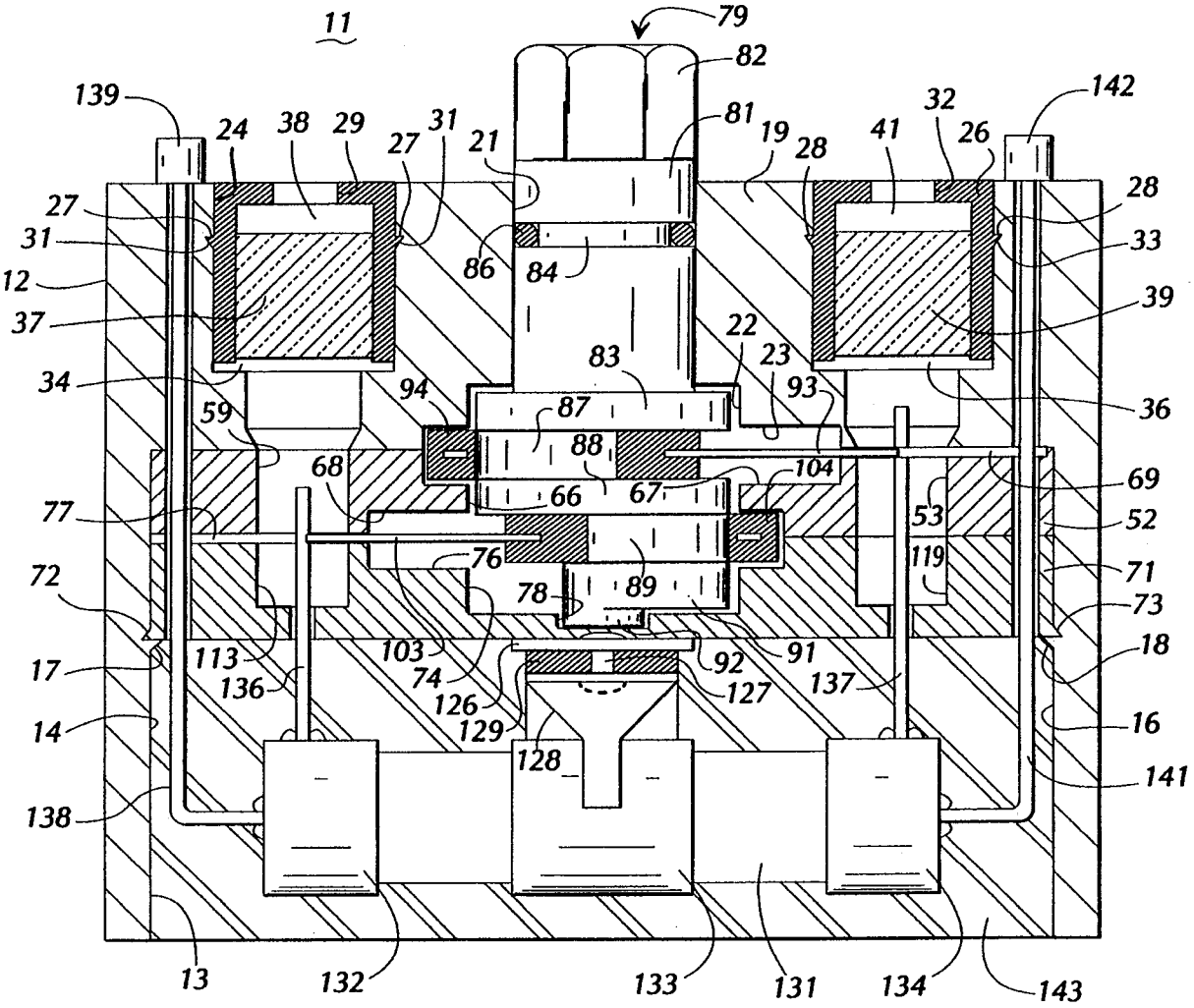
FIG. 1 is an elevation view in cross-section of the IDC switch or connector of the present invention.

The IDC switch connector 11 of FIG. 1 comprises a case 12 of suitable material such as injection molded plastic. As can be seen in FIG. 1, the bottom portion of case 12 has an open volume 13 which extends slightly more than halfway into the interior of the case. The interior walls 14 and 16 of this open volume have formed thereon a pair of aligned projections 17 and 18, the purpose of which will be discussed hereinafter. The upper portion 19 of case 12 has a central bore 21 therein, the lower end of which has a larger diameter portion 22 and a relieved portion 23, the purpose of which will be discussed more fully hereinafter. The upper portion 19 also has first and second rectangular bores 24 and 26 which extend into portion 19 and have recesses 27 and 28 formed therein. Located within bore 24 is an inverted cup member 29 of a suitable plastic material having projections 31 thereon which fit within recesses 27 to hold cup 29 in place. When the unit 11 is assembled, cup 29 is inserted into bore 24 until the projections 31 snap into recesses 27. In like manner, a cup 32 having projections 33 is snapped into place in bore 26, with projections 33 fitted within recesses 28. It is to be understood that other means for holding cups 29 and 32 in place might readily be used, that shown in FIG. 1 being by way of example only.

At the bottom of bore 24 is located a rubber seal 34 of silicone or neoprene rubber, for example, which is quite thin, having a thickness of approximately 30 to 35 mils. At the bottom of bore 26 is located a similar seal 36. Cups 29 and 32, when snapped into place within bores 24 and 26, bear against their respective seals 34 and 36. The interior of cup 29 is partially filled with a gel mass 37 of a soft plastic material of grease-like or gel like consistency such as a polyisobutylene or silicone grease, or a combination of polybutene synthetic rubber, mineral oil, amorphous silica, and an antioxidant, for example. The material has the characteristic that it clutches and seals against anything, such as a wire, inserted into it, and when a wire, for example, is pulled out of the mass, the material heals itself, closing the opening what is left. The material also has the characteristic that it fills and seals any gaps or interstices, thereby sealing any openings. The mass 37 substantially fills the space within cup 29, with the exception of a small expansion space 38 for the material of mass. In the same manner cup 32 has a gel mass 39 of the same material with an expansion space 41.

Figure 2:
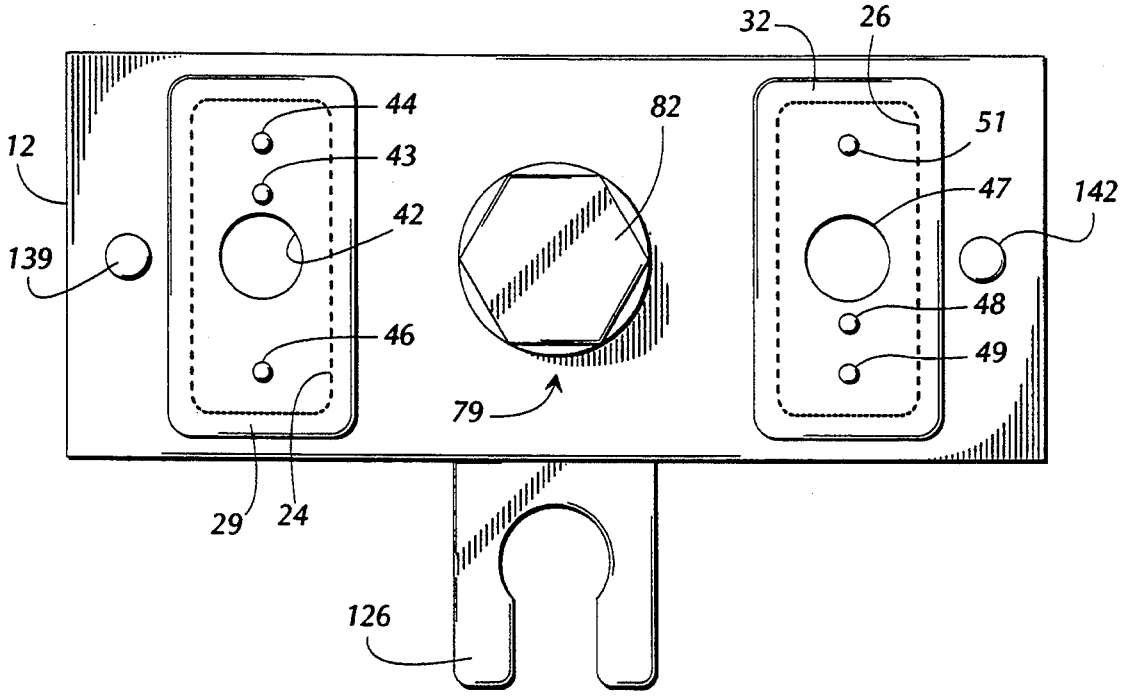
FIG. 2 is a plan view of the connector of FIG. 1.

As can be seen in FIG. 2, the top of cup 29 has a plurality of aligned holes 42, 43, 44, and 46. Hole 42 is of sufficient diameter to receive and pass an insulated drop wire, while holes 43, 44 and 46 are of sufficient diameter to receive the insulated wires from the customer premises. Likewise, cup 32 has aligned holes 47, 48, 49, and 51.

Figure 5A:
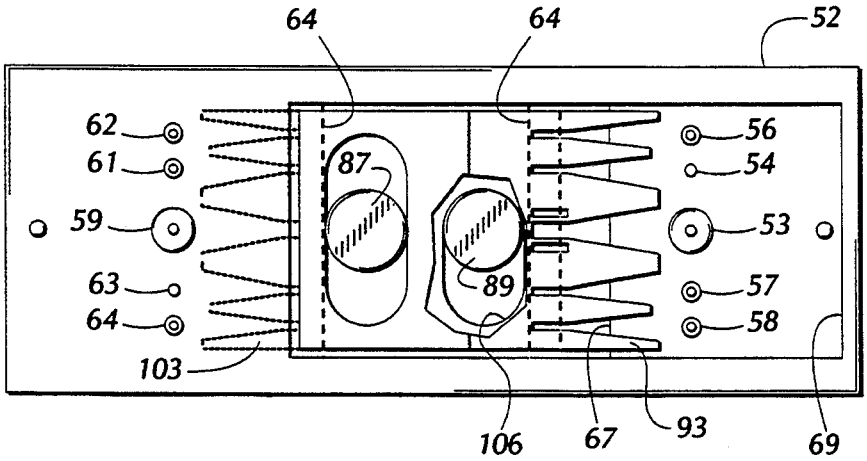

Bearing against the underside of portion 19 is a first spacer member 52 of suitable plastic material such as ABS (acrylo butadiene styrene), for example. Member 52 is dimensioned to fit within the open space 13 in substantially a slip fit, and, as best seen in FIG. 5A, has a plurality of wire receiving holes 53, 54, 56, 57, and 58, and 59, 61, 62, 63, and 64, which, when member 52 is in place, are aligned with corresponding holes in caps 29 and 32. Member 52 has a central bore 66 with stepped relief portions 67 and 68 on either side thereof. In FIG. 5A the bore 66 and relief portions 67 are shown as being rectangular in shape. They, as well as relief portion 68, may, however, be circular in shape so long as they meet certain criteria, to be discussed hereinafter. Relief portion 67 is aligned with relief portion 23 in portion 19 of case 12. Member 52 also has a rectangularly shaped cut-out 69 extending from relief 67, as seen in FIG. 1 and in FIG. 5A, which foris a space between member 19 and member 52.

Bearing against the underside of spacer 52 is a second spacer 71 having, at its lower edges, projections 72 and 73 which engage projections 17 and 18 to allow spacer 71 to be snapped into place and held in position, which likewise holds spacer 52 in position. Spacer 71 has a central bore 74 and stepped relief portion 76 in registry with relief portion 68 in spacer 52. Spacer 71 also has a rectangular cut-out portion 77 which creates a space between the top surface of spacer 71 and the lower surface of spacer 52. Bore 74 does not extend all the way through spacer 71 but rather it terminates in a small diameter hole 78 which, as will be apparent hereinafter, foris a thrust bearing surface. Spacer 71 likewise has a plurality of holes 113, 114, 116, 117 and 118 and 119, 121, 122, 123 and 124 for receiving the wires to be connected. These holes are in registry with corresponding holes in spacers 52, but do not necessarily extend all of the way through spacer 71, thus forming stops for the wires.

Figure 4:
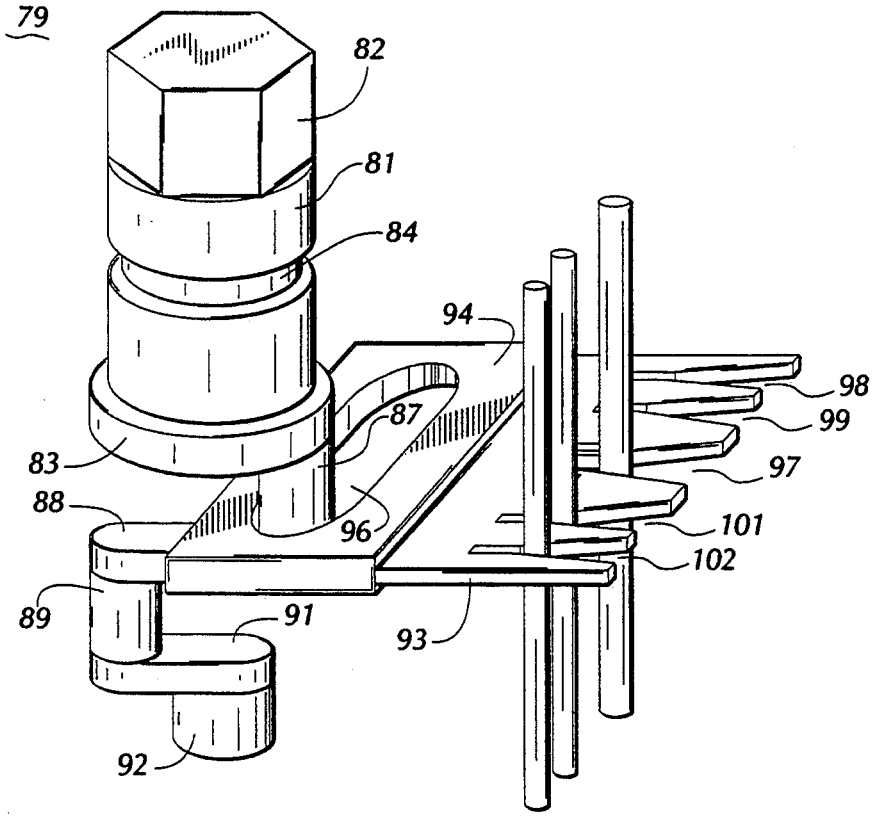
FIG. 4 is a perspective view of the actuating member of the apparatus of FIG. 1; and FIG, 5A and 5B are plan views illustrating the displacement of the insulation displacing members under the influence of the actuating member of FIG. 4.

Central bore 21 has located therein an actuating member 79 of suitable material, such as die cast zinc. Member 79 comprises a shaft 81 having a hexagonally shaped upper end 52 and, at its lower end, an enlarged circular flange 83. Intermediate the upper and lower ends is a groove 84 which contains an O-ring 86 of nitrile rubber, for example, which bears against the wall of bore 21 to form a seal. An off center crankshaft throw 87 is attached at one end to, or integral with, flange 83 and at its other end to crankshaft web 88. A second off-center crankshaft throw 89 is located on the other side of the central axis of actuator 79 from throw 87 between web 88 and an end web 91. End web 91 in turn terminates in a radial and thrust bearing member 92, as shown. In FIG. 4, the actuator 79 is shown in perspective.

Figure 3A:
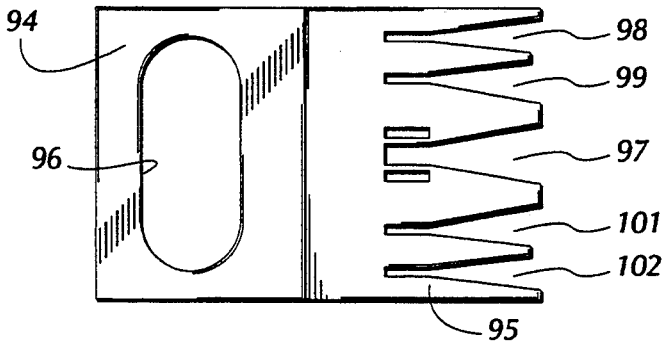
FIG. 3A and 3B are plan views of the insulation displacing members of the apparatus of FIG. 1.
Figure 3B:
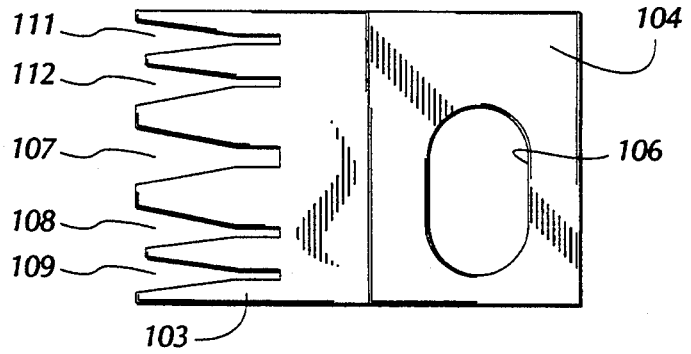

With reference to FIGS. 3A and 3B as well as FIG. 1, an insulation displacement blade 93 of material such as beryllium-copper, and its holder 94 of, for example, Delrin®, which has an elongated slot 96 therein, is mounted on throw 87, which extends through slot 96. The distal end of blade 93 has a plurality of V-shaped insulation displacing or cutting slots 97, 98, 99, 101 and 102 formed therein, each slot being adapted to receive a wire therein to which electrical contact is made when the wire is forced to the bottom of the V-groove. As seen in FIG. 1, blade 93 is contained within, and free to move in translation with respect to the spaced formed by cut-out 69 and the lower surface of member 19 into and away from the engaging or connecting region. A second blade 103 and its holder 104, which has a slot 106, is mounted to throw 89, with the blade being movably contained within the space formed by cut-out 77 and the lower surface of spacer 52. Blade 103 likewise has a plurality of V-shaped slots 107, 108, 109, 111 and 112 for cutting the insulation and engaging the wires.

Figure 5B:
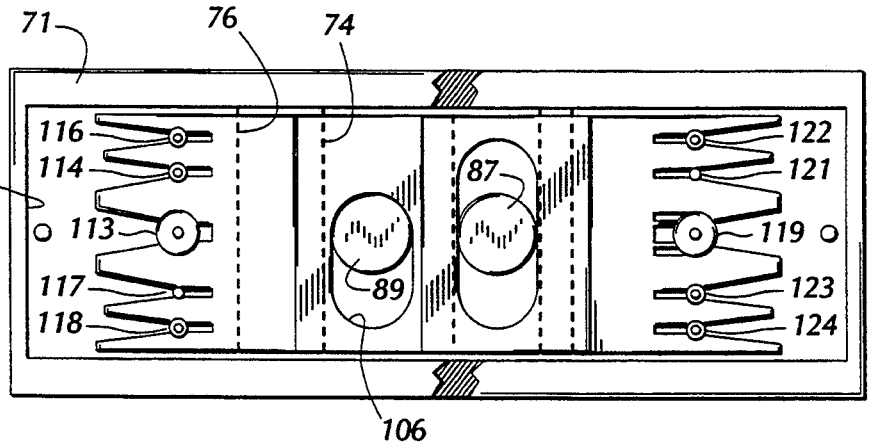

Referring to FIGS. 4, 5A and 5B, as well as FIG. 1, FIG. 5A depicts the position of blades 93 and 103 in the non-engaging or un-actuated position. In addition, the wires to be engaged are shown, in cross-section, positioned in the appropriate holes and extending through the engaging or connecting region. Customer wires are positioned, for example, in holes 56, 57, and 58 and in holes 61, 62, and 64 in spacer 52, and in corresponding holes 122, 123, and 124, and 114, 116, and 118 in spacer 71. The drop wire is bifurcated, with one wire being positioned in holes 53 and 119, and the other wire in holes 59 and 113. FIG. 5B depicts the positions of blades 93 and 103 in the actuated wire engaging position within the engaging or connecting region after actuating member 79 has been rotated approximately 180°. As is shown in FIG. 5B, the V-slots cut through the insulation on the wires and make good electrical contact with the wires theiselves. The final contact is made in the straight portion at the bottom of the slots. Second throw 89 bears against the end of slot 106 in both the fully unactuated position and the fully actuated position, thereby preventing further rotation of member 79 and lateral movement of the blades, thus preventing damage to the wires. The cut-outs 69 and 77 contain the blades 93 and 103 and constrain them for linear movement laterally into and out of the connecting region where they engage and electrically contact the wires or conductors.

Referring again to FIG. 1, the bottom of spacer 71 has affixed thereto a metallic ground lug 126, which projects from the side of case 12, as shown in FIG. 2. Attached to ground lug 126 by means of a rivet 127 is a metallic clip or bracket member 128. Bracket 128 is shown spaced from ground lug 126 by an insulating spacer 129, with electrical contact being provided by rivet 127. Alternatively, bracket 128 and ground lug 126 may bear against each other to afford positive electrical contact. Mounted in clip 128 is a gas discharge protector tube 131 having first, second, and third conducting electrodes 132, 133, and 134. It is to be understood that other types of protector devices might readily be used. In practice it has been found that the gas discharge device 131 is more than adequate.

Connected to electrode 132 as by soldering is a connecting wire 136 which extends upward through hole 117 in spacer 71 and into hole 63 in spacer 52. In like manner, a wire 137 extends from electrode 134 through holes 121 and 54. Thus, when the blades 93 and 103 are moved to the engaged position, wires 136 and 137 are electrically connected to the remaining wires, thereby electrically placing the discharge device 131 between the connections and ground so that when a surge voltage occurs, the tube conducts and shunts the connections to ground, thus preventing damage to any apparatus connected to the wires.

Also connected to electrode 132 is a test wire 138 which extends upward through holes in the spacers 71 and 52 and a hole in portion 19 of case 12 to a test lug 139. In like manner, a test wire 141 extends from electrode 134 through holes in spacers 71 and 52, and a hole in portion 19 to a test lug 142. Test lugs 139 and 142, with wires 138 and 141, which are insulated from the environment, make it possible for a technician to connect a test set to the circuit. The remainder of volume 13 is filled with a suitable potting compound 143.

The connector 11 of FIG. 1 is assembled as follows. Blade 93 is mounted on eccentric throw 87 of actuator 79 as shown. Slot 96 is dimensioned such that holder 94 can be threaded past elements 88, 89, 91 and 92 of the eccentric crank to where it rides on throw 87. O-ring 86 is placed in groove 84 and actuator 79 is then inserted into bore 21, and spacer 52 is placed in position. Blade 103 is then positioned onto throw 89 as shown and spacer 71 is snapped into place. Discharge device 131 is then mounted in bracket or clip 128, with wires 136, 137, 138, and 141 being passed through the designated holes. The remainder of volume 13 is then filled with the potting compound 143, thereby sealing the lower portion of case 12 and its contents from the elements or atmosphere. Lugs 139 and 142 may then be mounted to case 12 and electrically connected to wires 138 and 141, respectively. Rubber seals 34 and 36 are placed in bores 24 and 26 and cups 29 and 32 may then be snapped into place and filled with gel masses 37 and 39 respectively, with a small expansion space within the cups left unfilled, as shown. The assembly as thus far described takes place at the point of manufacture, and the end result is a device, the interior of which is completely sealed from the ambient atmosphere. The assembled device 11 is carried by the installer to the point of use for connecting drop wires to the customer's wires. All that is necessary for the installer to do is to bifurcate the drop wire cable so that one wire can be fitted into hole 42 and the other into hole 47. The customer's wires may then be inserted into holes 43, 44, and 46 and 48, 49, and 51, although it may not be necessary to use all of the holes. The wires thus inserted are pressed down through the gel masses 37 and 39 and through the corresponding holes in spacers 52 and 71. As pointed out before, the gel completely grips the wires and effectively seals them in place. The actuator is then turned to move blades 93 and 103 through the insulation into contact with the wires and the connection is completed.

Although the embodiment of the invention as described in the foregoing is somewhat more complex than many prior art devices, it is this very complexity that makes installation so very simple and rapid, thereby materially reducing installation costs. Despite the moving parts in the device 11, the critical area where the connections are made is completely sealed from the ambient atmosphere. Additionally, the device is re-usable in that wires may be removed and other wires inserted without violating the integrity of the seal. Although the structure shown in FIG. 1 appears bulky, in actuality, it is quite compact, being approximately two inches high, two and one-quarter inches long, and three quarters of an inch wide.

The foregoing has been a description and discussion of a preferred embodiment of the feature and principles of the invention. Numerous variations or modifications may occur to workers in the art without departure from these principles.

I claim:

1. A connection device for electrically connecting two or more conductors comprising:

a case member having an axial bore extending therethrough;

at least one opening extending into said case having an axis substantially parallel to the axis of said bore, said opening being adapted to receive two or more conductors to be electrically connected;

a conductor engaging member for electrically connecting in an engaging region the conductors received in said opening; and actuating means rotatably mounted in said bore and having an axis of rotation for moving said conductor engaging [means]member linearly and laterally in a plane at an angle relative to the axis of said bore for physically and electrically engaging the conductors extending through said opening.

2. A connection device as claimed in claim 1 wherein said conductor engaging member comprises a first substantially flat electrically conducting blade having slots at one end thereof for engaging the conductors, said blade being movable in a plane substantially transverse to the axis of rotation of said actuating means.

3. A connection device as claimed in claim 1 wherein said accumulating means comprises a shaft journaled in said case having an eccentric member at one end thereof offset from the axis of rotation of said actuating member and engaging said conductor engaging member.

4. A connection device as claimed in claim 1 and further including means for preventing said conductor engaging member from severing the conductors, said means comprising limiting means for limiting the rotation of said actuating means.

5. A connection device as claimed in claim 1 wherein said opening contains a self-healing insulating gel.

6. A connection device as claimed in claim 1 wherein said case member has a solid portion and a hollow portion, and a protective device mounted within said hollow portion.

7. A connection device as claimed in claim 6 wherein said protective device has at least one conductor attached thereto, said conductor extending into said engaging region for engagement by said conductor engaging member.

8. A connection device as claimed in claim 6 wherein said hollow portion is at least partially filled with an insulating material.

9. A connection device for electrically connecting two or more conductors comprising:

a case member having a substantially solid portion and a hollow portion, said solid portion having an axial bore extending therethrough;

an opening extending into said solid portion in a direction substantially parallel to the axis of said bore;

a closure member for said opening, said closure member having two or more conductor receiving openings therein for receiving conductors to be electrically connected together;

a mass of insulating and sealing material within said opening, said insulating material being adapted to permit passage of conductors therethrough;

a first movable insulation displacement member for electrically connecting the conductors passed through said mass of insulating material into a connecting region, said insulation displacement member being movable into and away from said connecting region in a plane substantially perpendicular to the axis of said bore;

means for constraining the movement of said first insulation displacement member to linear movement only; and actuating means having an axis of rotation rotatably mounted in said bore for moving said displacement member toward and away from said connecting region.

10. A connection device as claimed in claim 9 and further including means for limiting the rotation of said actuating means.

11. A connection device as claimed in claim 9 wherein said hollow region is at least partially filled with an insulating material.

12. A connection device as claimed in claim 9 wherein said means for constraining the movement of said first insulation displacement member comprises a first spacer member within said hollow portion, said first spacer member having a cut-out-portion within which said displacement member moves.

13. A connection device as claimed in claim 12 wherein said means for constraining the movement of said second insulation displacement member comprises a second spacer member within said hollow portion, said second spacer member having a cut-out portion within which said second displacement member moves.

14. A connection device as claimed in claim 9 and further comprising a second insulation displacement member, a second connecting region, and means for constraining the movement of said second insulation displacement member into and away from said connecting region to linear movement in a plan substantially perpendicular to the axis of said bore.

15. A connection device as claimed in claim 14 wherein said actuating means comprises a shaft journaled in said solid portion of said case and extending into said hollow portion, said shaft having a first eccentric member at the end thereof within said hollow portion, said eccentric member being offset from the axis of rotation of said actuating means.

16. A connection device as claimed in claim 15 wherein said first insulation displacement member is mounted on said first eccentric member.

17. A connection device as claimed in claim 15 and further comprising a second eccentric member adjacent to said first eccentric member and offset from the axis of rotation, said second eccentric member being offset from said first eccentric member approximately 180° relative to said axis of rotation.

18. A connection device as claimed in claim 17 wherein said second insulation displacement member is mounted on said second eccentric member.

19. A connection device as claimed in claim 9 and further comprising a protective device mounted within said hollow portion.

20. A connection device as claimed in claim 19 wherein said protective device has at least one conductor attached thereto, said conductor extending into said connecting region for engagement by said first insulation displacement member.

21. A connection device for electrically connecting two or more conductors comprising:

a case member having an axial bore extending therethrough;

at least one opening extending into said case having an axis substantially parallel to the axis of said bore, said opening being adapted to receive two or more conductors to be electrically connected;

a conductor engaging member for electrically connecting in an engaging region the conductors received in said opening, said conductor engaging member comprising a first substantially flat electrically conducting blade having slots for engaging the conductors:

actuating means rotatably mounted in said bore and having an axis of rotation for moving said conductor engaging member laterally in an plane at an angle relative to the axis of said bore for physically and electrically engaging the conductors extending through said opening; and said conducting blade being movable in a plane substantially transverse to the axis of rotation of said actuating means.

22. A connection device for electrically connecting two or more conductors comprising:

a case member having an axial bore extending therethrough;

at least one opening extending into said case having an axis substantially parallel to the axis of said bore, said opening being adapted to receive two or more conductors to be electrically connected;

a conductor engaging member for electrically connecting in an engaging region the conductors received in said opening;

actuating means rotatably mounted in said bore and having an axis of rotation for moving said conductor engaging member laterally in a plane at an angle relative to the axis of said bore for physically and electrically engaging the conductors extending through said opening; and said actuating means comprising a shaft journaled in said case having an eccentric member at one end thereof offset from the axis of rotation of said actuating member and engaging said conductor engaging member.

* * * * *

UNITED STATES PATENT AND TRADEMARK OFFICE

CERTIFICATE OF CORRECTION

PATENT NO. : 5,368,501

DATED : November 29, 1994

INVENTOR(S) : Oscar D. Asbell

It is certified that error appears in the above-indentified patent and that said Letters Patent is hereby corrected as shown below:

Column 1, line 28, change "suscessible" to --susceptible--.

Column 2, line 42, change "prier" to --prior--.

Column 5, line 6, change "foris" to --forms--.
Column 5, line 20, change "foris" to --forms--.

Column 6, line 12, change "theiselves" to --themselves--.

Column 7, line 63, "[means]" should be deleted.

Column 8, line 6, change "accumulating" to --actuating--.

Column 9, line 3, change "12" to --14--.

UNITED STATES PATENT AND TRADEMARK OFFICE

CERTIFICATE OF CORRECTION

PATENT NO. : 5,368,501

DATED : November 29, 1994

INVENTOR(S) : Oscar D. Asbell

It is certified that error appears in the above-indentified patent and that said Letters Patent is hereby corrected as shown below:

Column 1, line 41, after "wires" change "is" to --are--.

Column 2, line 24, change "too" to --, too--.

Column 10, line 15, change "an plane" to --a plane--.

Signed and Sealed this

Twenty-eight Day of February, 1995

*Attest:*

Bruce Lehman

BRUCE LEHMAN

*Attesting Officer*

*Commissioner of Patents and Trademarks*